US006890151B2

(12) United States Patent
Bertrand et al.

(10) Patent No.: US 6,890,151 B2
(45) Date of Patent: May 10, 2005

(54) FIXED GUIDE VANE ASSEMBLY SEPARATED INTO SECTORS FOR A TURBOMACHINE COMPRESSOR

(75) Inventors: Jean-Louis Bertrand, Livry sur Seine (FR); Jean-Marc Claude Perrollaz, Hericy (FR)

(73) Assignee: Snecma Moteurs, Paris (FR)

( * ) Notice: Subject to any disclaimer, the term of this patent is extended or adjusted under 35 U.S.C. 154(b) by 0 days.

(21) Appl. No.: 10/283,279

(22) Filed: Oct. 30, 2002

(65) Prior Publication Data

US 2003/0082051 A1 May 1, 2003

(30) Foreign Application Priority Data

Oct. 31, 2001 (FR) ..... 01 14102

(51) Int. Cl.[7] ..... F04D 29/54

(52) U.S. Cl. ..... 415/209.2; 415/209.3; 415/215.1; 415/214.1

(58) Field of Search ..... 415/209.2, 209.3, 415/215.1, 214.1

(56) References Cited

U.S. PATENT DOCUMENTS

| | | | | |
|---|---|---|---|---|
| 2,945,290 A | | 7/1960 | Walsh | |
| 3,365,173 A | * | 1/1968 | Lynch et al. | 415/209.3 |
| 4,126,405 A | | 11/1978 | Bobo et al. | |
| 4,889,470 A | * | 12/1989 | Scalzo | 415/209.2 |
| 5,141,395 A | * | 8/1992 | Carroll et al. | 415/209.2 |
| 5,197,856 A | * | 3/1993 | Koertge et al. | 415/209.3 |
| 5,752,804 A | | 5/1998 | Benoist et al. | |
| 5,846,050 A | * | 12/1998 | Schilling | 415/209.2 |
| 6,296,443 B1 | | 10/2001 | Newman et al. | |

FOREIGN PATENT DOCUMENTS

| | | |
|---|---|---|
| DE | 2 728 015 | 6/1996 |
| EP | 1 104 836 | 6/2001 |

* cited by examiner

*Primary Examiner*—Edward K. Look
*Assistant Examiner*—Igor Kershteyn
(74) *Attorney, Agent, or Firm*—Oblon, Spivak, McClelland, Maier & Neustadt, P.C.

(57) ABSTRACT

A fixed guide vane assembly includes a circular casing composed of at least two parts (11) and supporting sectors (5), each composed of an inner segment (7) and an outer segment (6) connected by vanes (8). The parts of the casing and the sectors of the guide vane assembly are held together by a system forming a slide and a slider. An anti-rotation mechanism (30) is provided to prevent the sectors from rotating with respect to the casing.

23 Claims, 4 Drawing Sheets

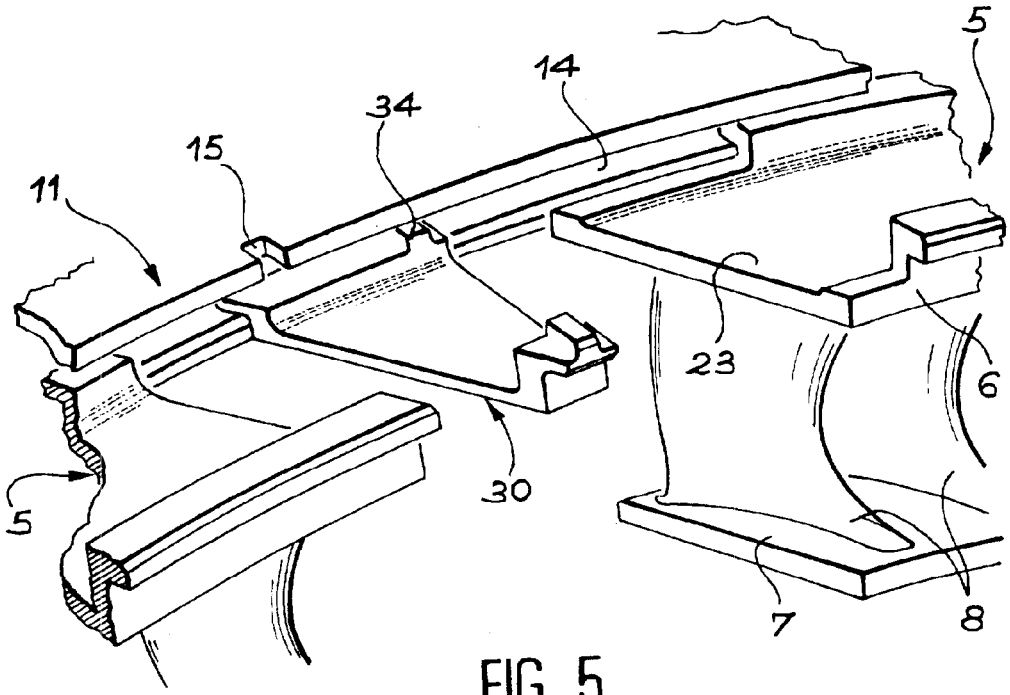
FIG. 5
FIG. 6
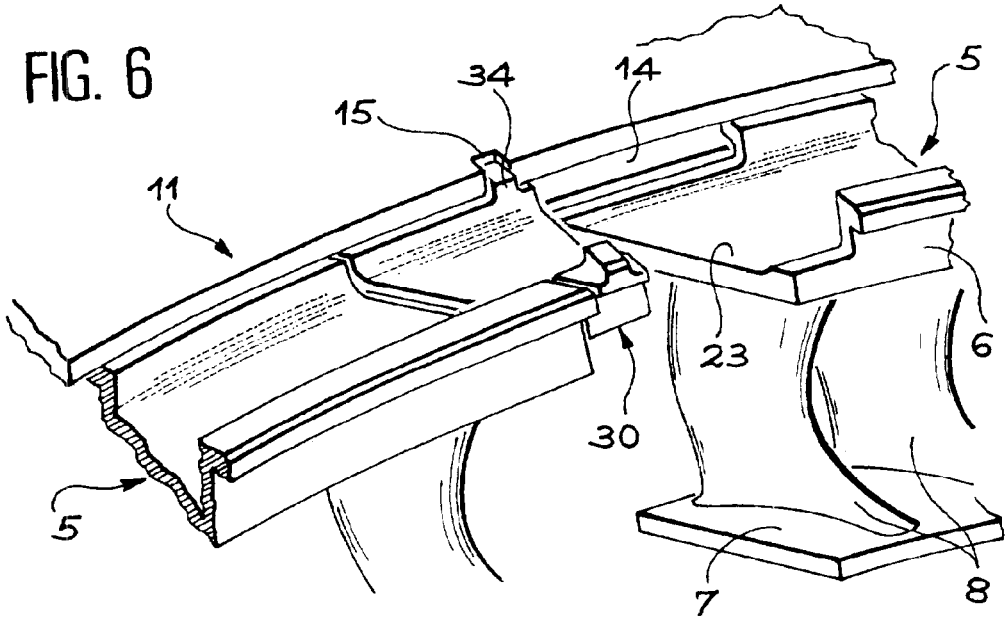

FIXED GUIDE VANE ASSEMBLY SEPARATED INTO SECTORS FOR A TURBOMACHINE COMPRESSOR

TECHNICAL DOMAIN

The invention presented herein concerns the high pressure turbine of a turbomachine such as a turbojet used on an aircraft. More precisely, it concerns a fixed guide vane assembly separated into sectors for a turbomachine compressor.

STATE OF PRIOR ART

There is a very large variety of compressors for turbomachines. Manufacturers efforts are being made to improve performances, and also to improve manufacturing, reduce costs and ease of maintenance.

One known improvement consisted of separating the fixed guide vane assembly of the compressor for a turbomachine into sectors. Patent U.S. Pat. No. 4,126,405 divulges a segmented assembly of a turbine distributor.

Document FR-A-2 728 015 divulges a turbine stator distributor comprising sectors each composed of an inner segment and an outer segment connected together by vanes. A casing built into the compressor stator will support the sectors placed in contact with each other. Anti-rotation means are provided to prevent rotation of the sectors supported by the casing.

PRESENTATION OF THE INVENTION

This invention was designed to further improve manufacturing and the cost of a fixed guide vane assembly for a turbo-machine compressor. This is done by making the casing in two or more parts, to facilitate manufacturing. The parts of the casing and the guide vane assembly sectors are held together by a slide and slider system. Means of preventing rotation are provided to prevent the sectors from rotating with respect to the casing.

Therefore, the purpose of the invention is a fixed sectorized guide vane assembly for a compressor in a turbomachine comprising:

- sectors in the shape of an arc of a circle each composed of an inner segment and an outer segment connected by vanes,
- a circular casing integrated into the compressor stator, that will support the sectors in contact with each other,
- anti-rotation means designed to prevent sectors supported by the casing from rotating, characterized in that:
- the casing is composed of at least two parts, in contact with each other and fixed to each other at joint planes and including means forming a slide,
- the sectors form slider means adapted to the means forming a slide in the parts of the casing,
- and anti-rotation means comprise anti-rotation means fixed to the joint planes of the parts of the casing by attachment means, and anti-rotation means blocked on the parts of the casing by locking means at the contact between the sectors.

Preferably, the casing is composed of two parts in the form of a semi-circle.

According to one preferred variant embodiment, the casing comprises two radial sides facing each other, the means forming a slide comprise two opposite grooves formed in the sides, the edges of the outside segments of the sectors forming means forming a slide.

The anti-rotation means fixed to the joint planes may then comprise at least one strip held immobile between the two grooves by the said attachment means and forming a stop for a sector sliding in a slide in a casing. This strip may be a two-arm clip inserted by bringing the two arms towards each other in the reception housings provided in the grooves, and fixed in place in these housings by releasing the two arms, thus forming the said attachment means. The anti-rotation means fixed to the joint planes may also comprise at least one anti-rotation lock composed of an element comprising means forming a slider adapted to the means forming a slide in the parts of the casing, the element also comprising immobilization means on the casing. These immobilization means may be of mortise and tenon type, with a tenon engaging in the mortise when the element is pushed in a direction perpendicular to the direction in which the element slides in the casing, thus forming the said attachment means. One of the ends of the outer segment of the sector adjacent to the said element may have a clearance such that the element can be pushed into the said perpendicular direction when this adjacent sector is slid to come into contact with the said element.

The anti-rotation means blocked on the parts of the casing may then comprise at least one anti-rotation lock formed of an element comprising means forming a slider adapted to the said means forming a slide in the parts of the casing, the element also comprising immobilization means on the casing. These immobilization means may be of the mortise and tenon type, the tenon fitting into the mortise when the element is pushed in a direction perpendicular to the direction in which the element slides in the casing, thus forming the said blocking means. One of the ends of the outer segment of a sector adjacent to the said element have a clearance such that the element can be pushed in the said perpendicular direction, when this adjacent sector is slid to come into contact with the said element.

BRIEF DESCRIPTION OF THE DRAWINGS

The invention will be better understood and other advantages and special features will become clear after reading the following description given as a non-limitative example, accompanied by the attached drawings among which:

FIGS. 5 and 6 illustrate two steps in the placement of an anti-rotation lock between two sectors of a fixed sectorized guide vane assembly according to the invention.

DETAILED DESCRIPTION OF EMBODIMENTS OF THE INVENTION

Figure 1:
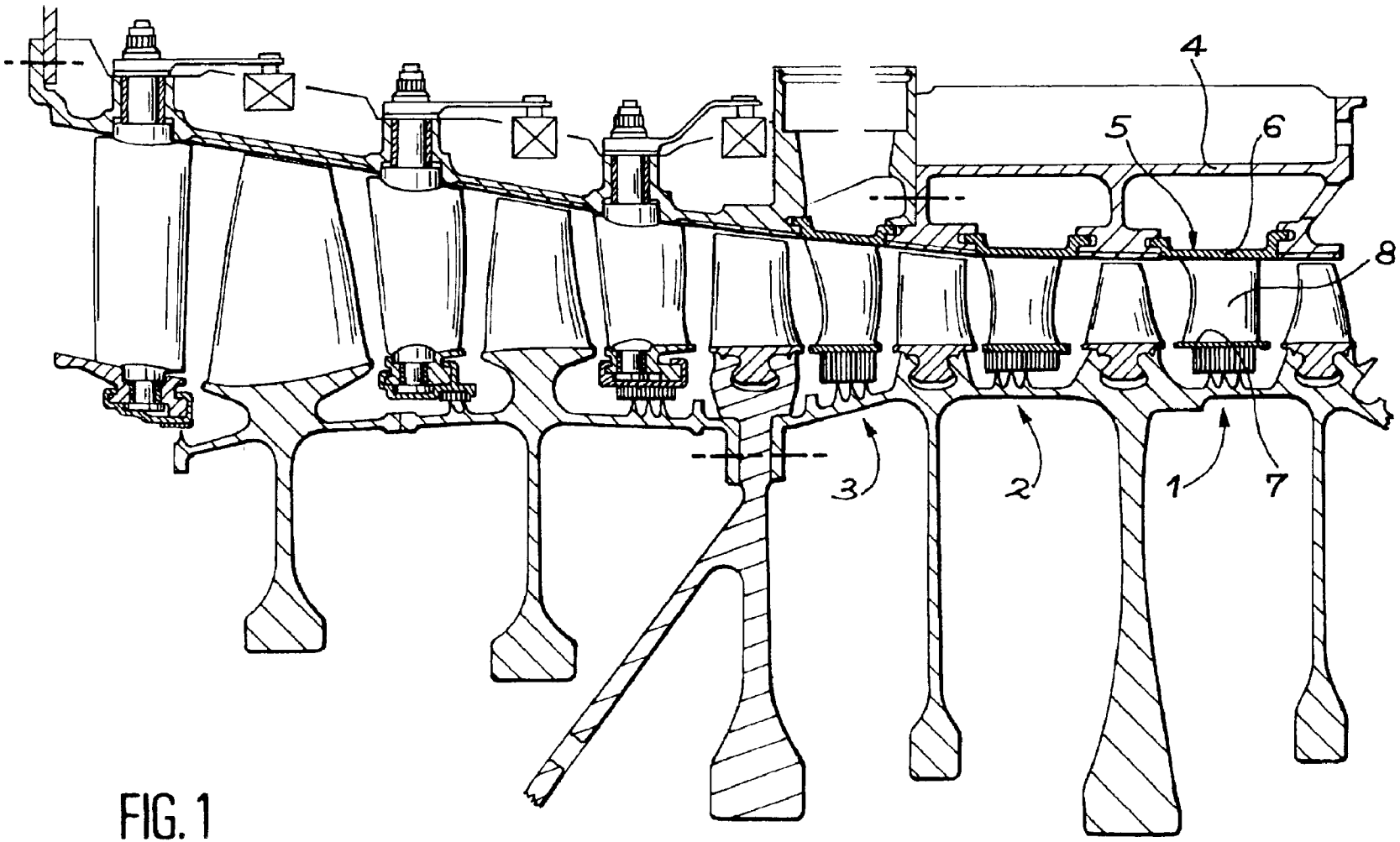
FIG. 1 is a partial sectional view of a turbo-machine compressor using a fixed sectorized guide vane assembly according to the invention.

FIG. 1 is a partial sectional view of the compressor of a turbomachine using fixed sectorized guide vane assemblies 1, 2 and 3 according to the invention. These guide vane assemblies are functionally identical.

We will describe guide vane assembly 1 more precisely. It comprises a circular casing 4 integrated into the compressor stator and supporting sectors such as sector 5.

A sector 5 is composed of an inner segment 7 and an outer segment 6 connected to each other by vanes 8.

Figure 2:
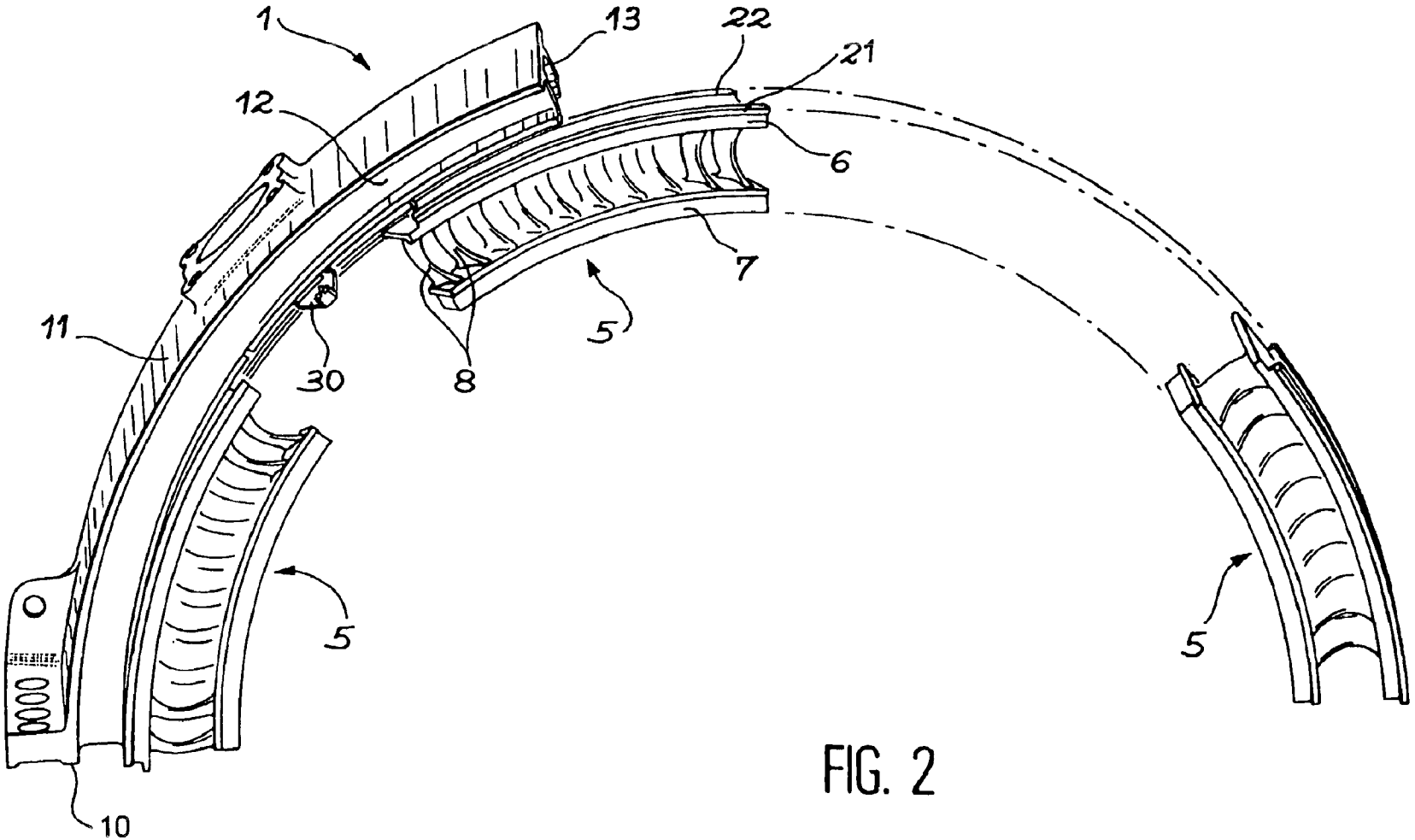
FIG. 2 is a partial oblique view of a fixed sectorized guide vane assembly according to the invention.

FIG. 2 is a partial and exploded view of the sectorized fixed guide vane assembly 1. For example, it comprises a casing in two parts in the form of a semi-circle. FIG. 2 shows a partial view of one of the parts 11 of this casing with one of its joint planes 10 that will be fixed on the corresponding joint plane of the other part of the casing. Three sectors 5 currently being assembled are represented. For a sector 5, the outer segment 6, the inner segment 7 and the connecting vanes 8 can be recognized.

The part of the casing 11 comprises two radial sides 12 and 13 facing each other and each provided with a groove. The grooves are facing each other to form a slide. The edges 21 and 22 of the outer segment 6 of the sector 5 project outwards to act as a slider free to slide in the slide formed by the part of casing 11.

Before engaging a first sector 5 onto the part of the casing 11, an anti-rotation lock is installed on the joint plane 10 of the part of the casing 11. This may be a strip or lock such as that shown in FIG. 4.

FIG. 2 also shows an anti-rotation lock 30 placed between two sectors 5. This lock 30 is shown in an oblique view in FIG. 3. It is formed of an element 31 placed between the two sides 12 and 13 of the part of the casing 11 (see FIG. 2). The element 31 is in the shape of an arc of a circle and is continued by an outer edge 32 and an inner edge 33. The edges 32 and 33 are designed such that the lock 30 can slide in the grooves of the part of the casing 11. The outer edge 32 comprises a pin 34 projecting from the plane of the element 31. The same is applicable for the pin 35 on the inner edge 33.

FIGS. 5 and 6 illustrate two steps in the placement of an anti-rotation lock 30 between two sectors 5. A single one of the sides of the part of the casing 11 has been shown to facilitate understanding. The groove 14 provided in this side can be seen.

FIG. 5 shows a first sector 5 already installed (at the left of the figure) and a second sector 5 in the process of being installed (at the right of the figure). A lock 30 was inserted between these two sectors by sliding. It will be noted that the height of the groove 14 enables the passage of the outer edge of lock 30 with its pin 34.

The element 30 slides until it comes into contact with the first sector 5. For element 30, this corresponds to a relative position with respect to the part of the casing 11 such that the pin 34 is facing a notch 15 machined in the part of the casing 11. All that is necessary then is to push upwards on the lock 30 (for the view shown in FIGS. 5 and 6) so that the pin 34 can penetrate into the notch 15, and the lock 30 then stays in the raised position.

The second sector 5 may then be pushed towards the lock 30. This second sector 5 has a clearance 23 at the end in contact with the lock 30, such that part of the outer segment 6 passes under the lock 30.

Figure 3:
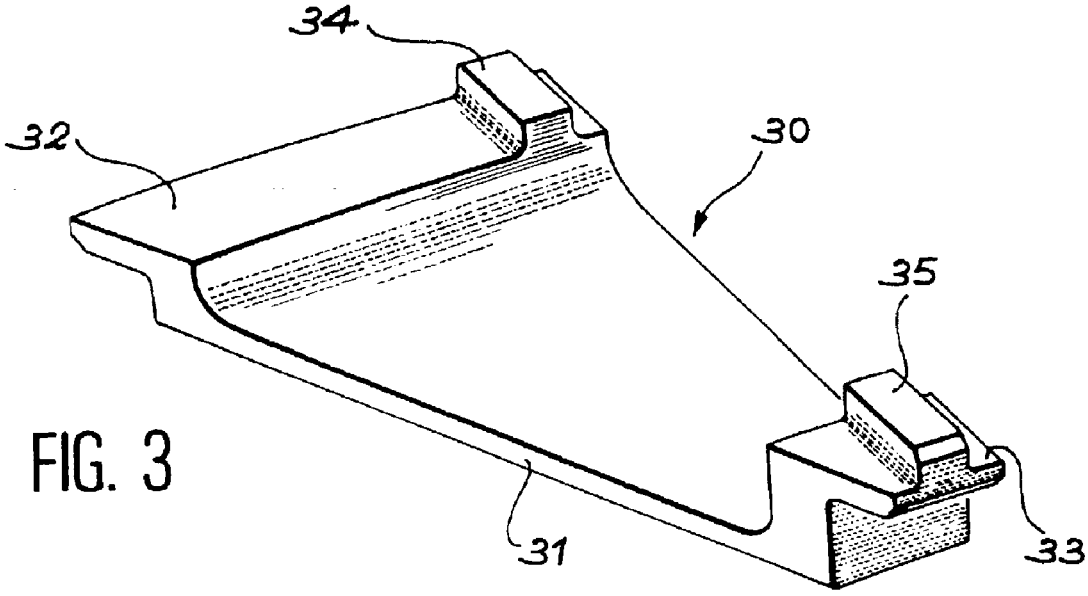
FIG. 3 is an oblique view of an anti-rotation lock for the joint plane of part of a casing for the fixed sectorized guide vane assembly according to the invention.
Figure 4:
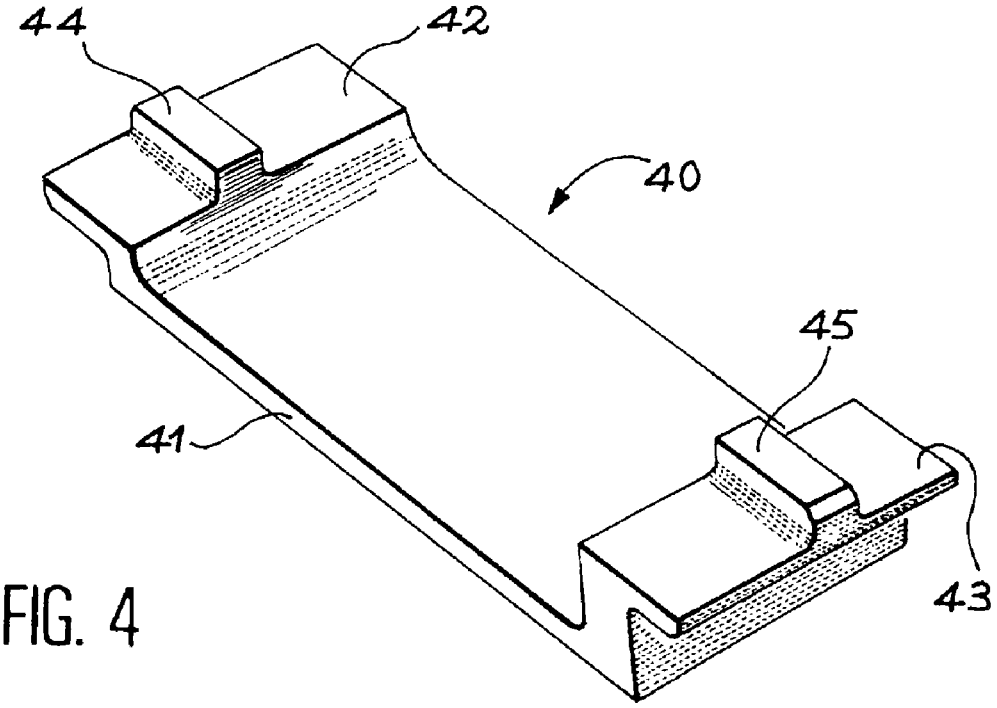
FIG. 4 is an oblique view of an anti-rotation lock placed between two sectors of a fixed sectorized guide vane assembly according to the invention.

The anti-rotation lock 40 at the joint plane shown in FIG. 4 is installed in the same way as the lock in FIG. 3. It is formed of an element 41 that is placed between the two sides of the part of the casing. The element 41 is continued by an outer edge 42 and an inner edge 43. The outer edge 42 comprises a pin 44 projecting from the plane of the element 41. The same is true for the pin 45 on the inner edge 43.

What is claimed is:

1. Fixed sectorized guide vane assembly for a compressor of a turbomachine, comprising:

sectors in the shape of an arc of a circle each composed of an inner segment and an outer segment connected by vanes, a circular casing integrated into the compressor stator, that will support the sectors in contact with each other, anti-rotation means designed to prevent sectors supported by the casing from rotating, wherein:

the casing is composed of at least two parts, in contact with each other and fixed to each other at joint planes and including means forming a slide, the sectors form slider means adapted to the means forming a slide in the parts of the casing, and anti-rotation means comprise anti-rotation means fixed to the joint planes of the parts of the casing by attachment means, and anti-rotation means blocked on the parts of the casing by locking means at the contact between sectors, the casing comprises two radial sides facing each other, the means forming a slide comprise two grooves opposite each other formed in the sides, the edges of the outer segments of the sectors forming the slider, the anti-rotation means fixed to the joint planes comprise at least one strip immobilized between the two grooves by said attachment means and forming a stop for the sector sliding in the slide in the casing, and the strip is a two-arm clip inserted by bringing two arms towards each other in reception housings provided in the grooves, and immobilized in these housings when the two arms are released, thus forming said attachment means.

2. Fixed sectorized guide vane assembly for a compressor of a turbomachine, comprising:

sectors in the shape of an arc of a circle each composed of an inner segment and an outer segment connected by vanes, a circular casing integrated into the compressor stator, that will support the sectors in contact with each other, anti-rotation means designed to prevent sectors supported by the casing from rotating, wherein:

the casing is composed of at least two parts, in contact with each other and fixed to each other at joint planes and including means forming a slide, the sectors form slider means adapted to the means forming a slide in the parts of the casing, and anti-rotation means comprise anti-rotation means fixed to the joint planes of the parts of the casing by attachment means, and anti-rotation means blocked on the parts of the casing by locking means at the contact between sectors, the casing comprises two radial sides facing each other, the means forming a slide comprise two grooves opposite each other formed in the sides, the edges of the outer segments of the sectors forming the slider, and the anti-rotation means blocked on the parts of the casing comprise at least one anti-rotation lock formed by an element comprising means forming a slider adapted to the means forming a slide in the parts of the casing, the element also comprising immobilization means on the casing.

3. Fixed sectorized guide vane assembly according to claim 2, wherein the immobilization means are of the tenon—mortise type, a tenon becoming engaged in the mortise when the element is pushed in a direction perpendicular to the direction of sliding of the element in the casing, thus forming said blocking means.

4. Fixed sectorized guide vane assembly according to claim 3, wherein the clearance of one of the ends of the outer segment of a sector adjacent to said element is such that when this adjacent sector is slid to come into contact with said element, the element can be pushed in said perpendicular direction.

5. Fixed sectorized guide vane assembly for a compressor of a turbomachine, comprising:

sectors in the shape of an arc of a circle each composed of an inner segment and an outer segment connected by vanes, a circular casing integrated into the compressor stator, that will support the sectors in contact with each other, anti-rotation means designed to prevent sectors supported by the casing from rotating, wherein the casing is composed of at least two parts, in contact with each other and fixed to each other at joint planes and including means forming a slide, the sectors form slider means adapted to the means forming a slide in the parts of the casing, and anti-rotation means comprise anti-rotation means fixed to the joint planes of the parts of the casing by attachment means, and anti-rotation means blocked on the parts of the casing by locking means at the contact between sectors, the anti-rotation means fixed to the joint planes comprise at least one strip immobilized between the two grooves by said attachment means and forming a stop for the sector sliding in the slide in the casing, and the strip is a two-arm clip inserted by bringing two arms towards each other in reception housings provided in the grooves, and immobilized in these housings when the two arms are released, thus forming said attachment means.

6. Fixed sectorized guide vane assembly according to claim 5, wherein the immobilization means are of the tenon—mortise type, a tenon becoming engaged in the mortise when the element is pushed in a direction perpendicular to the direction of sliding of the element in the casing, thus forming said blocking means.

7. Fixed sectorized guide vane assembly according to claim 6, wherein the clearance of one of the ends of the outer segment of a sector adjacent to said element is such that when this adjacent sector is slid to come into contact with said element, the element can be pushed in said perpendicular direction.

8. Fixed sectorized guide vane assembly for a compressor of a turbomachine, comprising:

sectors in the shape of an arc of a circle each composed of an inner segment and an outer segment connected by vanes, a circular casing integrated into the compressor stator, that will support the sectors in contact with each other, anti-rotation means designed to prevent sectors supported by the casing from rotating, wherein the casing is composed of at least two parts, in contact with each other and fixed to each other at joint planes and including means forming a slide, the sectors form slider means adapted to the means forming a slide in the parts of the casing, and anti-rotation means comprise anti-rotation means fixed to the joint planes of the parts of the casing by attachment means, and anti-rotation means blocked on the parts of the casing by locking means at the contact between sectors, the anti-rotation means blocked on the parts of the casing comprise at least one anti-rotation lock formed by an element comprising means forming a slider adapted to the means forming a slide in the parts of the casing, the element also comprising immobilization means on the casing.

9. Fixed sectorized guide vane assembly according to claim 8, wherein the immobilization means are of the tenon—mortise type, a tenon becoming engaged in the mortise when the element is pushed in a direction perpendicular to the direction of sliding of the element in the casing, thus forming said blocking means.

10. Fixed sectorized guide vane assembly according to claim 9, wherein the clearance of one of the ends of the outer segment of a sector adjacent to said element is such that when this adjacent sector is slid to come into contact with said element, the element can be pushed in said perpendicular direction.

11. A vane assembly for a compressor, comprising:

sectors each having an inner segment and an outer segment connected by vanes;

a casing configured to support the sectors in contact with each other; and an anti-rotation lock between two adjacent sectors and configured to prevent said sectors supported by the casing from rotating, wherein said anti-rotation lock has an edge configured to fit into a groove of said casing and a pin on said edge configured to fit into a notch in said casing.

12. A vane assembly according to claim 11, wherein said sectors and said anti-rotation lock are in the shape of an arc of a circle.

13. A vane assembly according to claim 11, wherein the casing is composed of two parts.

14. A vane assembly according to claim 13, wherein said two parts are in the form of a semi-circle.

15. A vane assembly according to claim 13, wherein said two parts are in contact with each other.

16. A vane assembly according to claim 15, wherein said two parts are fixed to each other at joint planes.

17. A vane assembly according to claim 11, wherein the casing comprises two radial sides facing each other.

18. A vane assembly according to claim 11, wherein said casing is circular.

19. A vane assembly according to claim 11, wherein said edge is an outer edge of said anti-rotation lock.

20. A vane assembly according to claim 11, wherein said edge is an inner edge of said anti-rotation lock.

21. A vane assembly according to claim 11, wherein said anti-rotation lock comprises an inner edge and an outer edge, each edge being configured to fit into a groove of said casing.

22. A vane assembly according to claim 21, wherein each of said inner and outer edges has a pin configured to fit into a notch in said casing.

23. A vane assembly according to claim 11, wherein said groove has a height that enables passage of said edge with said pin.

* * * * *